United States Patent [19]

Maier et al.

[11] 4,201,324

[45] May 6, 1980

[54] ARRANGEMENT FOR TRANSPORTING A MAGAZINE THROUGH A SETTING DEVICE

[75] Inventors: Elmar Maier, Tisis, Austria; Othmar Heeb, Ruggell, Fürstentum, Liechtenstein

[73] Assignee: Hilti Aktiengesellschaft, Schaan, Liechtenstein

[21] Appl. No.: 936,593

[22] Filed: Aug. 24, 1978

[30] Foreign Application Priority Data

Aug. 29, 1977 [DE] Fed. Rep. of Germany ..... 2738848

[51] Int. Cl.[2] ..... B25C 1/14

[52] U.S. Cl. ..... 227/9; 227/136

[58] Field of Search ..... 227/8, 9, 10, 11, 136

[56] References Cited

U.S. PATENT DOCUMENTS

| | | | |
|---|---|---|---|
| 1,162,677 | 11/1915 | Boden | 227/136 X |
| 3,703,981 | 11/1972 | Smith | 227/136 |
| 3,891,133 | 6/1975 | Maier et al. | 227/136 X |
| 3,910,324 | 10/1975 | Nasiatka | 227/136 X |
| 4,074,843 | 2/1978 | Oesterle | 227/10 X |

FOREIGN PATENT DOCUMENTS

| | | | |
|---|---|---|---|
| 267507 | 7/1970 | U.S.S.R. | 227/136 |

*Primary Examiner*—Paul A. Bell

*Attorney, Agent, or Firm*—Toren, McGeady and Stanger

[57] ABSTRACT

In a setting device, a magazine is advanced through a guide channel to present fastening elements in the path of a driving member. The magazine is moved in a stepwise manner by a transport pawl, and the pawl, in turn, is reciprocated relative to the drive channel by an operating member. A linkage interconnecting the operating member and the transport pawl, includes a pin secured to the operating member extending into a triangularly shaped recess in the transport pawl. The pin pivots the transport pawl out of engagement with the magazine in the guide channel and moves the pawl rearwardly so that it can again engage the magazine and move it so that another fastening element is aligned with the driving member.

9 Claims, 2 Drawing Figures

1
2
3
4
5
5a
6
7
8
8a
9
10
10a
11
12
12a
14
1a
1b
II
II

ARRANGEMENT FOR TRANSPORTING A MAGAZINE THROUGH A SETTING DEVICE

SUMMARY OF THE INVENTION

The present invention is directed to a setting device for driving fastening elements and, more particularly, is directed to apparatus within such a device for moving fastening elements held in a belt-shaped magazine into the path of a driving member. The apparatus includes a transport pawl for moving the magazine through a guide channel and an operating member for effecting the movement of the transport pawl.

In setting devices for driving fastening elements, it is known to feed a belt-shaped magazine by a transport pawl which pawl is elastically supported and is in engagement by means of a saw-toothed cam with recesses in the magazine. When the transport pawl is moved opposite to the feed direction of the magazine, it is disengaged from the recess in the magazine against the biasing action of a spring acting on the pawl, due to the sloping configuration of the saw-toothed cam. When released, the transport pawl slides along the edge of the magazine until it engages in the next recess. When the transport pawl is then moved in the feed direction of the magazine, the magazine is displaced by a length equal to the spacing between two adjacent fastening elements in the magazine. When the cam on the transport pawl is engaged in the recess in the magazine, it locks the magazine against movement only in the direction opposite to its feed direction, whereas the magazine can still be moved in the feed direction. When a transporting movement is carried out very quickly, it is possible that the magazine does not come to a standstill and is "overthrown" in the feed direction, that is, it is transported beyond a point in alignment with the driving member in the setting device. As a result, operational difficulties develop and damage may occur to individual parts of the setting device.

Therefore, the primary object of the present invention is to provide a transporting arrangement which assures the feeding movement of the magazine through an exactly defined distance each time the magazine is moved.

In accordance with the present invention, the transport pawl is interconnected with the operating member by a linkage arrangement. The transport pawl is controlled by the linkage and can only be disengaged from the magazine when the linkage is operated via the operating member. As a result, when the pawl is in engagement with the magazine, the magazine is locked against movement either forwardly or rearwardly through the guide channel. The magazine cannot move apart from the displacement effected by the transport pawl. For simple production and assembly it is advantageous if the linkage arrangement consists of a recess in the transport pawl and a pin secured to the operating member and engaged within the recess. Since the transport pawl has a relatively complicated shape, it must be formed either by several cutting operations or by a punching operation. In such operations the recess can be provided in the transport pawl without any significant additional work. Further, the pin secured to the operating member can act as a shearing element in the event one of the parts becomes jammed and, if necessary, it can be easily replaced.

The recess in the transport pawl can have various shapes. An essential requirement of the shape of the recess, however, is that it has a surface against which the pin abuts that is disposed obliquely to the direction of movement of the operating member. A slot extending obliquely of the direction of movement of the operating member would afford the simplest arrangement of the recess. If such a slot were used, however, it would result in a forced control in both directions of movement of the transport pawl so that it would still be possible for a jam to occur at the beginning of the feed movement if the recesses in the magazine are not exactly aligned with the cam of the transport pawl. To avoid this possibility, it is preferable to provide the recess with a generally triangular shape. As a result, the forced control of the transport pawl occurs only during its disengagement from a magazine, while the engagement of the transport pawl into a recess in the magazine can take place when the cam on the pawl is located exactly opposite a recess in the magazine. Accordingly, any jamming action is avoided.

To ensure the engagement of the transport pawl into the recesses along the edge of the magazine and to avoid any premature disengagement of the pawl during operation, it is preferable if a spring member biases the transport pawl toward the guide channel containing the magazine. In principle, the spring member can be constructed as a spiral spring, a cup spring or a flat spring as well as a rubber buffer. It is advantageous, however, if the spring member is a flat spring, since such a spring takes up a minimum of space and, usually, there is not much space available in a setting device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
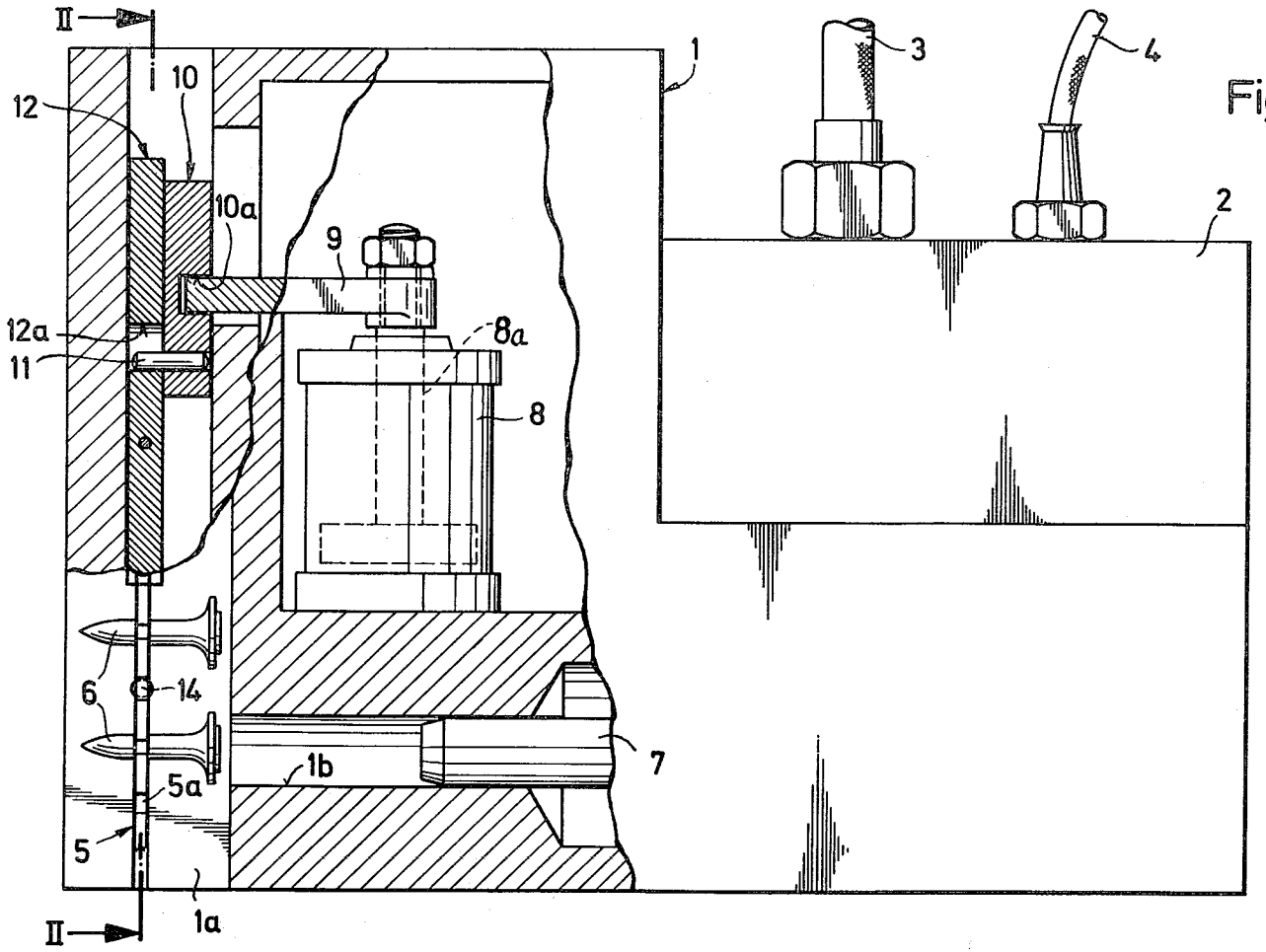
FIG. 1 is a side view of a fastening element setting device embodying the present invention with a portion of the device broken away along the line I—I in FIG. 2.

In FIG. 1 a setting device for driving fastening elements, such as nails, consists of a housing 1. As viewed in FIG. 1, the left-hand end of the housing is its front and the right-hand end is its rear. Mounted on top the rear portion of the housing is a control valve 2. Mounted on the control valve 2 is a compressed air connection 3 and an electrical connection 4 for the remote control of the setting device. Extending downwardly through the front portion of the housing 1 is a guide channel 1*a*. A belt-like magazine 5 holding a plurality of fastening elements or nails 6 in spaced relation, is inserted into the guide channel. Further, the housing contains a piston guide 1*b* extending perpendicularly of the guide channel 1*a* so that, in turn, the fastening element 6 can be aligned in front of the piston guide 1*b* which contains a piston 7 for driving the fastening elements. The magazine feed is operated by a cylinder 8 located in the housing and containing a piston 8a. The piston 8a moves up and down within the cylinder 8 and a finger 9 is connected to the upper end of the piston above the top of the cylinder and extends transversely of the direction of movement of the piston. The opposite end of the finger 9 from the piston is seated within a groove 10a of a movable operating member 10. Due to the connection of the finger 9 between the piston 8a and the operating member 10, the operating member follows the movement of the piston. Below the groove 10a, a pin 11 is secured into the operating member 10 and extends outwardly from it transversely of the direction of movement of the piston. A transport pawl 12 is located in the housing 1 alongside the operating member 10 and is linked to the operating member via the pin 11 so that it moves in the same manner as the operating member. A recess 12a is formed in the transport pawl 12 and the recess has a dimension in the direction of movement of the operating member 10 which is considerably greater than the diameter dimension of the pin 11. Due to the height of the recess 12a, when the operating member 10 moves upwardly from the position shown in FIG. 1, the pin 11 will travel over the height of the recess before it commences the upward movement of the transport pawl 12, that is, the pawl remains idle during the initial upward movement of the operating member. The upward movement of the operating member 10 and of the transport pawl 12 due to the linkage connection between them is opposite to the feed direction of the magazine 5 through the guide channel 1a. Movement of the magazine is controlled so that a transport movement of the piston 8a in the cylinder 8 takes place after each complete working stroke and return stroke of the piston 7 in driving a fastening element from the setting device.

Figure 2:
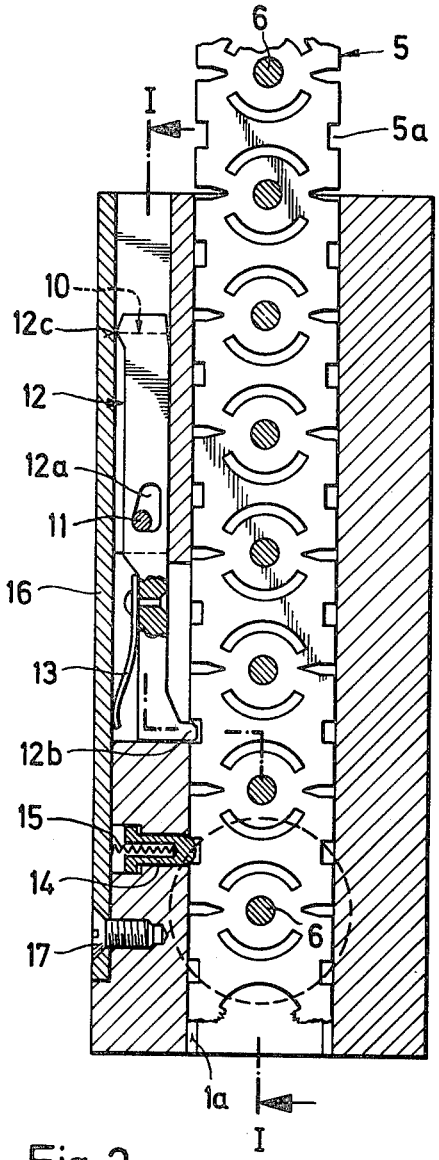
FIG. 2 is a sectional view of the setting device in FIG. 1 taken along the line II—II.

FIG. 2 displays a sectional view through the guide channel 1a in the housing 1. The upper end of the guide channel is its inlet end and the lower end is its outlet end. The magazine 5 is inserted downwardly through the inlet end of the guide channel and it has recesses 5a along each of the sides which serve in moving the magazine in a step-wise manner through the guide channel so that the fastening elements 6 can be aligned in the path of the piston 7 moving through the piston guide 1b. At its lower end, the transport pawl 12 has a cam 12b directed inwardly toward the guide channel 1a. The cam 12b engages one of the recesses 5a along one side edge of the magazine. To permit engagement of the cam 12b within a recess 5a without any play and to prevent an overthrowing of the magazine 5 at high transport velocity, the surface of the cam directed toward the guide channel is frusto-conically shaped. As a result, the cam 12b acts as a lock and makes possible the exact positioning of a fastening element 6 in the path of the piston located within the piston guide 1b. The transport pawl moves upwardly and downwardly within a passage in the housing. Along the side of the passage more remote from the guide channel, the transport pawl 12 is disposed in spaced relation to the side except near its upper end where a projection 12c is in contact with the side and forms a point about which the pawl can be pivoted. On the opposite side of the transport member from the guide channel is a flat spring 13 which biases the transport pawl toward the guide channel. When the operating member 10, located behind the transport pawl 12 in FIG. 2 is actuated, the pin 11 positioned within the recess 12a bears against the surface of the recess extending obliquely of the direction of movement of the operating member and causes the lower end of the transport pawl to pivot about the projection 12c against the biasing action of the flat spring 13 in the clockwise direction, as viewed in FIG. 2, until its cam 12b is disengaged from the recess 5a in the magazine. Since the diameter of the pin is significantly smaller than the height of the recess, it moves upwardly for a certain distance before the pin commences to move the transport pawl 12. When the pin reaches the upper end of the recess it moves the transport pawl in the upward direction. At the completion of the upward stroke, that is, as the operating member 10 commences its downward return stroke, the transport pawl 12 remains stationary for a brief time due to the braking effect of the flat spring 13. During the initial downward movement of the operating member 10, the pin 11 moves downwardly through the recess 12a without moving the transport pawl until it reaches the base of the triangularly shaped recess. Accordingly, the transport pawl is pivoted inwardly toward the guide channel and engages the next upper recess 5a of the magazine due to the biasing action of the flat spring 13. The cam 12b is then in position to move the magazine downwardly through one spacing dimension of the fastening elements in the magazine as the operating member 10 continues its downward movement. As a result, because of the shape of the recess 5a and the difference of the dimension of the diameter of the pin and the height of the recess, the stroke of the piston 8a in the cylinder 8, effecting the feed of the magazine, can be somewhat greater than the fastening element spacing in the magazine without causing any jamming of the transporting apparatus.

To prevent any movement of the magazine 5 through the guide channel 1a when the cam 12b of the transport pawl 12 is pivoted out of engagement from a recess 5a in the magazine 5, an additional locking device is provded in the path of the magazine moving through the guide channel. The locking device consists of a locking member 14 pressed by a spring 15 toward the guide channel 1a. The locking member is arranged to engage one of the recesses 5a in the magazine 5. The holding action of the locking member 14 and the spring 15 is such that the downward movement of the pawl 12 overcomes its holding action and permits the magazine to be moved. To afford a simple assembly of the transport apparatus, it is covered within the housing 1 by a plate 16. Screws 17 secure the plate 16 to the housing 1.

In the drawing, the setting device is shown operated by compressed air. The setting device, however, could be powered by some other drive means instead of compressed air, for example, by an explosive powder charge or other driving source. Furthermore, the feed magazine illustrated could also be used for moving a magazine containing explosive powder charges and such charges could be contained within cartridges or of the caseless type.

While specific embodiments of the invention have been shown and described in detail to illustrate the application of the inventive principles, it will be understood that the invention may be embodied otherwise without departing from such principles.

We claim:

1. Setting device for driving fastening elements comprises a housing, means in said housing for driving the fastening elements, a guide channel in said housing having an inlet end and an outlet end and arranged to receive a belt-shaped magazine holding fastening elements in spaced relation, and transport means within said housing for moving a magazine through said guide channel in a step-wise manner in the direction from the inlet end to the outlet end for aligning individual fastening elements held by the magazine in the path of said driving means, said transport means comprising a transport pawl for engaging and moving a magazine through said guide channel, and an operating member for moving said transport pawl in a reciprocating manner in the direction between the inlet end and outlet end of said guide channel, wherein the improvement comprises linking means interconnecting said operating member and said transport pawl for moving said transport pawl in response to the movement of said operating member and for pivoting said transport pawl out of engagement with a magazine in said guide channel so that said transport pawl can be moved toward the inlet end of said guide channel preparatory to re-engaging the magazine for moving it in a step-wise manner through said guide channel toward the outlet end thereof, said linkage means comprises a recess in said transport pawl, and a pin secured to said operating member and extending into said recess in said transport pawl, said recess having a dimension in the direction between the inlet end and the outlet end of said guide channel which is greater than the diametral dimension of said pin so that in response to the movement of said operating member said pin can move in the direction between the inlet end and outlet end for a certain distance before commencing the movement of said transport pawl in the same direction, said recess having a surface in contact with said pin as said pin moves through said recess in the direction toward the inlet end of said guide channel so that the initial movement of said pin along the pin contact surface in said recess causes said transport pawl to pivot out of engagement with the magazine before said pin commences the movement of said transport pawl toward the inlet end of said guide channel.

2. Setting device as set forth in claim 1, wherein said recess in section in the plane extending across said guide channel in the same plane as a magazine moving through said guide channel has a triangular shape with the base of the triangular shaped recess being closer to the outlet end of said guide channel, and the pin contact surface in said recess extending from said base toward the inlet end of said guide channel.

3. Setting device, as set forth in claim 2, wherein said triangularly shaped recess having a first side and a second side each extending from the base thereof in the direction toward the inlet end of said guide channel, said first side being closer to said guide channel than said second side and extending generally parallel to the axis of said guide channel extending between the inlet and outlet ends thereof, and said second side forming said pin contact surface and converging toward said first side from the base of said triangularly shaped recess toward the apex thereof.

4. Setting device, as set forth in claim 1, wherein said transport means includes a spring member biasing said transport pawl toward said guide channel for engagement with a magazine therein and opposing the pivotal movement of said transport pawl when it is displaced out of engagement with a magazine within said guide channel by the action of said pin moving along said pin contact surface in said recess in the direction toward the inlet end of said guide channel.

5. Setting device, as set forth in claim 4, wherein said transport pawl has a cam at the end thereof more remote from the inlet end of said guide channel and said cam projecting toward said guide channel and biased by said spring member into said guide channel, said cam arranged to engage and move a magazine through said guide channel.

6. Setting device, as set forth in claim 5, wherein said cam has a frusto-conically shaped surface at the end thereof projecting toward said guide channel with the frusto-conically shaped surface extending around an axis extending transversely of the direction between the inlet end and outlet end of said guide channel.

7. Setting device, as set forth in claim 6, wherein auxiliary locking means are mounted in said housing and are spring-biased into said guide channel for holding a magazine therein when said cam on said transport pawl is displaced out of engagement with the magazine.

8. Setting device, as set forth in claim 4, wherein said spring member is a flat spring.

9. Setting device, as set forth in claim 1, wherein said housing including a pair of spaced opposed wall surfaces extending in the direction between the inlet and outlet ends of said guide channel and forming a passage therebetween for the reciprocal movement of said transport pawl, said passage extending in the direction between the inlet and outlet ends of said guide channel, one of said wall surfaces being closer to said guide channel than the other, when said transport pawl is in position securing a magazine within said guide channel one side of said transport pawl is in contact with the one of said wall surfaces and the opposite side of said transport pawl is in spaced relation to the other of said wall surfaces for a major portion of the length thereof from the end of said transport pawl more remote from the inlet end of said guide channel to the end closer to said inlet end of said guide channel, and the opposite side of said transport pawl being in contact with the other said wall surface adjacent the end of said transport pawl closer to the inlet end of said guide channel so that said transport pawl can be pivoted about the surface of contact thereat by the action of said pin moving along said pin contact surface in said recess in the direction toward the inlet end of said guide channel with said transport pawl at the end more remote from the inlet end of said guide channel moving toward the other said wall surface within said passage.

* * * * *